US009554679B2

(12) United States Patent
Hong et al.

(10) Patent No.: US 9,554,679 B2
(45) Date of Patent: Jan. 31, 2017

(54) QUICK ASSEMBLY AND DISASSEMBLY MECHANISM WITH BUTTON LOCK FOR A TOILET COVER

(71) Applicant: XIAMEN R&T PLUMBING TECHNOLOGY CO., LTD., Xiamen (CN)

(72) Inventors: Diyi Hong, Xiamen (CN); Weiquan Xie, Xiamen (CN); Bing Wang, Xiamen (CN)

(73) Assignee: XIAMEN R&T PLUMBING TECHNOLOGY CO., LTD., Xiamen (CN)

( * ) Notice: Subject to any disclaimer, the term of this patent is extended or adjusted under 35 U.S.C. 154(b) by 694 days.

(21) Appl. No.: 13/869,606

(22) Filed: Apr. 24, 2013

(65) Prior Publication Data

US 2013/0333104 A1 Dec. 19, 2013

(30) Foreign Application Priority Data

Jun. 13, 2012 (CN) ..... 2012 1 0193150

(51) Int. Cl.
*A47K 13/12* (2006.01)
*A47K 13/26* (2006.01)

(52) U.S. Cl.
CPC ..... *A47K 13/12* (2013.01); *A47K 13/26* (2013.01)

(58) Field of Classification Search
CPC ..... A47K 13/12; A47K 13/26
USPC ..... 4/236, 240, 242.1; 70/71
See application file for complete search history.

(56) References Cited

U.S. PATENT DOCUMENTS 5,361,423 A * 11/1994 Notzold ..... A47K 13/26 4/237
8,122,523 B2 * 2/2012 Li ..... A47K 13/12 4/236
8,327,471 B2 * 12/2012 Fielding, Jr. ..... A47K 13/26 4/236

FOREIGN PATENT DOCUMENTS

| | | | | |
|---|---|---|---|---|
| CN | 201303910 Y | | 9/2009 | |
| CN | 201767898 U | * | 3/2011 | ..... A47K 13/12 |
| CN | 201767898 U | | 3/2011 | |
| CN | 201968594 U | * | 9/2011 | ..... A47K 13/12 |
| CN | 201968594 U | | 9/2011 | |
| CN | 202154626 U | * | 3/2012 | ..... A47K 13/12 |
| CN | 202154626 U | | 3/2012 | |
| WO | WO-2012019527 A1 | | 2/2012 | |

OTHER PUBLICATIONS

China Patent Office, Office Action issued on Aug. 19, 2013.

* cited by examiner

*Primary Examiner* — Paul R. Durand
*Assistant Examiner* — Nicholas Ros
(74) *Attorney, Agent, or Firm* — Rabin & Berdo, P.C.

(57) ABSTRACT

A quick assembly and disassembly mechanism with a button lock for a toilet cover has a straight tube pivot joint, two stands and two pivot shafts. Each pivot shaft is disposed with pin holes in the radial direction. A lock bar disposed between the pivot shafts can slide side to side. The straight tube is disposed with an operation mechanism to drive the lock bar to slide. A spring is disposed inside the straight tube to reposition the lock bar. The lock bar is disposed with a lock catch and a lock piece with lock hole. The lock catch has an elastic body and a lock piece to limit the sliding of the lock bar and a pivot shaft, which is plugged to the end of the lock bar in sliding way. The lock piece in the end of the lock bar is disposed with a lock hole.

19 Claims, 16 Drawing Sheets

QUICK ASSEMBLY AND DISASSEMBLY MECHANISM WITH BUTTON LOCK FOR A TOILET COVER

FIELD OF THE INVENTION

The present invention relates to an assembly mechanism of a toilet cover, especially to a quick assembly and disassembly mechanism with button lock for a toilet cover.

BACKGROUND OF THE INVENTION

The existing quick pivot device of the cover and the toilet is applied with a lock shaft assembly stand, for example, a button type quick lock switch is separately assembled in the left and the right part of the rear part of the cover. The Chinese utility model patent with publication number CN201767898U is provided with a hinge structure of a toilet cover, which comprising a cover connected to the toilet with a hinge, the hinge comprising a hinge body to connect the cover and the toilet and an assembly base, the top surface of the assembly base is disposed with a connection cylinder, which is inserted to the hinge body, the hinge body includes a standstill block sliding in the lateral direction to limit the connection cylinder to move in the vertical direction, a stop pin sliding in the vertical direction to limit the connection cylinder to move and a reposition block sliding in the lateral direction inside the standstill block to control the pin to move downwards; the front part of the standstill block is connected with a button, a restoring spring is withstood between the button and the front surface of the reposition block, the bottom of the stop pin is withstood with a stop spring; this structure of button self-lock mechanism composed with the standstill block, the stop pin and reposition block and restoring spring is assembled inconvenient, it needs two hands to press the buttons in the left and right of the rear part of the cover when disassembling the cover, making it inconvenient to use, meanwhile, it needs two hands to overcome the force of the spring to press, making operation hard.

There is another Chinese patent with notification number CN201303910Y, which is provided with a toilet cover with a button control quick assembly device, a control cavity is disposed in the middle of the sleeve in the middle of the toilet seat with one step forming, two ends of the sleeve are separately assembled with a button quick lock switch (with spring themselves), the lock switch and the bottom of the cover are connected with a shaft, two sides of the control cavity are separately disposed with a push lever, the push levers of the control cavity and the lock switch are separately disposed with a spring, the button in the middle of the control cavity is linked to the two push levers, press the button, two push levers are separately withstood the spring between the push lever and the lock switch, and two push levers are separately withstood the spring between the lock switch and the button (the spring is disposed inside the lock switch), then the button pushes the push levers to move separately to push the buttons of the lock switches in two sides of the sleeve of the toilet seat, making the lock switch connected to the shaft quickly or separated from the shaft quickly, it is the finish of the quick assembly and disassembly of the cover; this kind of assembly and disassembly of the cover is structural complex, the button exposed out needs to overcome four springs' force to control the push lever to push the lock switch, though the single button is operated simple, pressing the button is inconvenient and hard, besides, as the button lock switch disposed in two ends of the cover are structural complex, any button lock switch is out of work, then the quick assembly and disassembly of the cover will not be realized. So the reliability is low.

SUMMARY OF THE INVENTION

To solve the problems that above quick assembly and disassembly structure of the cover is structural complex, assembled complex with high cost, and inconvenient to operate with low functional reliability, the present invention is provided with a quick assembly and disassembly mechanism with button lock for a toilet cover.

To solve above problems, the present invention is provided with a quick assembly and disassembly mechanism with button lock for a toilet cover, which comprising a straight tube pivot joint to the rear part of the cover, two stands connected to the toilet and two pivot shafts fixed to two ends of the straight tube symmetrically, the pivot shaft is disposed with pin holes in the radial direction, the pin holes are separately corresponding to the radial hole in the straight tube and the pin holes are separately plugged with the pins of the stands, wherein:

A lock bar disposed between the two pivot shafts can slide from side to side, two ends of the lock bar can be plugged and cooperated to the two pivot shaft by axial sliding;

The straight tube is disposed with an operation mechanism to drive the lock bar to slide, the operation mechanism is linked and cooperated to the lock bar, a spring is disposed inside the straight tube to make the lock bar repositioned;

One end of the lock bar is disposed with a lock catch with lock hole, the other end is disposed with a lock piece with lock hole, the lock piece can be plugged and cooperated to the pivot shaft by axial sliding, the lock holes in two ends of the lock bar are moving in the same direction to lock to the pins, which are separately plugged to the pin holes and the lock holes, or unlocked.

The lock catch comprising an elastic body and a lock piece to limit the sliding travel of the lock bar and a pivot shaft, which is plugged to the end of the lock bar in sliding way; in the lock catch, the lock piece in the end of the lock bar is disposed with a lock hole.

The pivot shaft is disposed with a lock surface and an unlock surface with interval in the axial direction; in the lock catch, when the elastic body is hooked to the lock surface, the lock holes are separately locked to the pins in two ends of the lock bar; when the elastic body is hooked to the unlock surface, the lock holes are separately unlocked to the pins in two ends of the lock bar, when the pin is separated from the pin hole, the pin withstands the elastic body to make the elastic body separated from the unlock surface.

The elastic body in one end of the lock bar in the lock catch is a pair of elastic arms with inner hook, and the ends of the elastic arms are disposed in the opposite direction, the elastic arm is clamped to an abdicating groove disposed in the pin with reducing diameter, the inner hook is hooked to the lock surface of the pivot shaft; the lock bar slides to make the elastic arm deformed and hooked to the unlock surface of the pivot shaft; when separated from the groove, the elastic arms are extensional deformed, making the inner hook separated from the unlock surface.

The lock holes in two ends of the lock bar moves in the same direction to lock to a lock groove with reducing diameter in the pin, which is plugged to the pin hole and the lock hole, or unlock.

Two ends of the spring are separately withstood one end of the pivot shaft and one end of the lock bar with lock catch.

The operation mechanism comprising a base sleeved and fixed to the straight tube and a manual body assembled in the base, operate the manual body to cooperate with the driven body in the middle of the lock bar to drive the lock bar to move to one end of the lock catch.

The lock bar comprising a left lock bar and a right lock bar locked and cooperated to each other, the driven body linked to the manual body is disposed in the left bar, which is cooperated to the lock catch in sliding way.

The manual body is a button assembled in the base, the middle of the button is disposed with a compression bar, the driven body is a guiding block with a guiding inclined surface, the compression bar and the guiding inclined surface of the guiding block are cooperated to drive the lock bar to move.

In another preferred embodiment, the manual body is a gear assembled in the base, the driven body is a rack, the gear is engaged to the rack.

In another preferred embodiment, the manual body is a lever balance button assembled in the base, the bottom of the balance button is disposed with a shifting lever, the driven body is a pushing block, the shifting lever and the pushing block are cooperated to drive the lock bar to move.

The pivot shaft comprising a rotary damper and a standstill shaft, which are coaxially connected to each other, the pin hole is disposed in the standstill shaft, the standstill shaft is sleeved into the straight tube, the rotating damper is exposed out of the end of the straight tube, two ends of the lock bar are separately plugged to the two standstill shafts in the axial direction in sliding way.

With above technical proposal, when the lock catch in one end of the straight tube is situated in initial state, the elastic body is locked to the lock surface, lock holes in two ends of the lock bar are separated locked to the two pins; with one hand operating the operation mechanism in the middle of the straight tube to drive the lock bar to move to the lock catch, that is to say, the lock holes in two ends of the lock bar are sliding in the same direction in side the pivot shafts in two ends of the straight tube, the elastic body in the lock catch is locked to the unlock surface after deformed, the spring is compressed and deformed, making the moving travel of one end of the lock bar in the lock catch self-locked, that is to say, just one end of the lock bar is self-locked in the lock catch to make the pins unlocked to the lock holes in two ends of the lock bar at the same time; when the pin is separated from the pin hole, the pin withstands the elastic body to make the elastic body separated from the unlock surface, with the effect of the spring, the lock bar and the operation mechanism are repositioned in linkage way.

The advantageous effects of the present invention are as below: only one end of the lock bar is travel self-locked in the lock catch in one end of the straight tube, making the pins unlocked to the lock holes in two ends of the lock bar, making the pivot shaft and the pin separable to realize the disassembly of the cover. The structure of the present invention is more simple with low cost and higher functional reliable and higher stability, besides, with only one spring applied for mechanism repositioning, hand operation of the present invention is more convenient.

REFERENCE SIGNS

Figure 1:
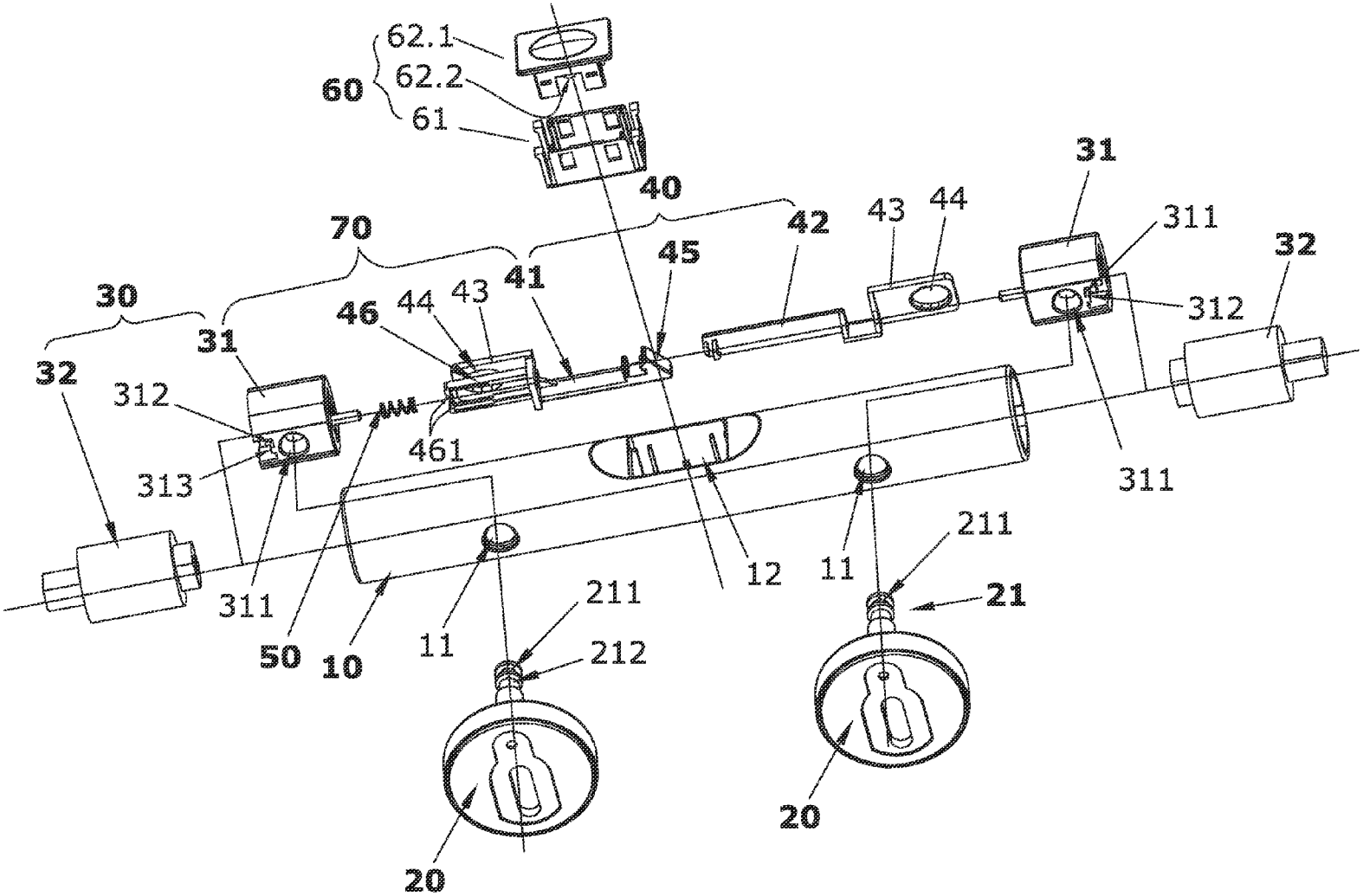
FIG. 1 illustrates the exploded view of the first embodiment of the present invention.
Figure 2:
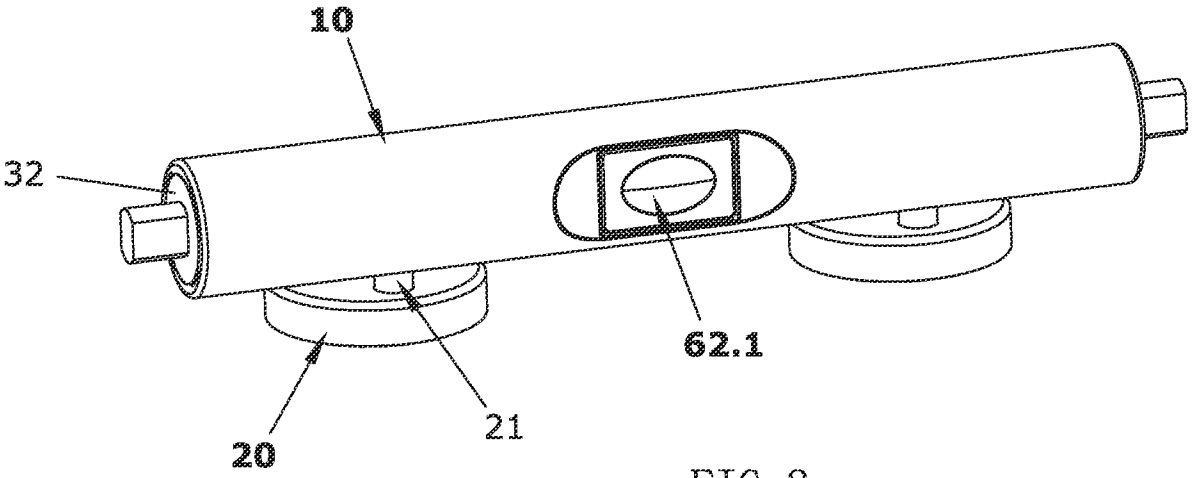
FIG. 2 illustrates the perspective view of the first embodiment of the present invention.
Figure 3:
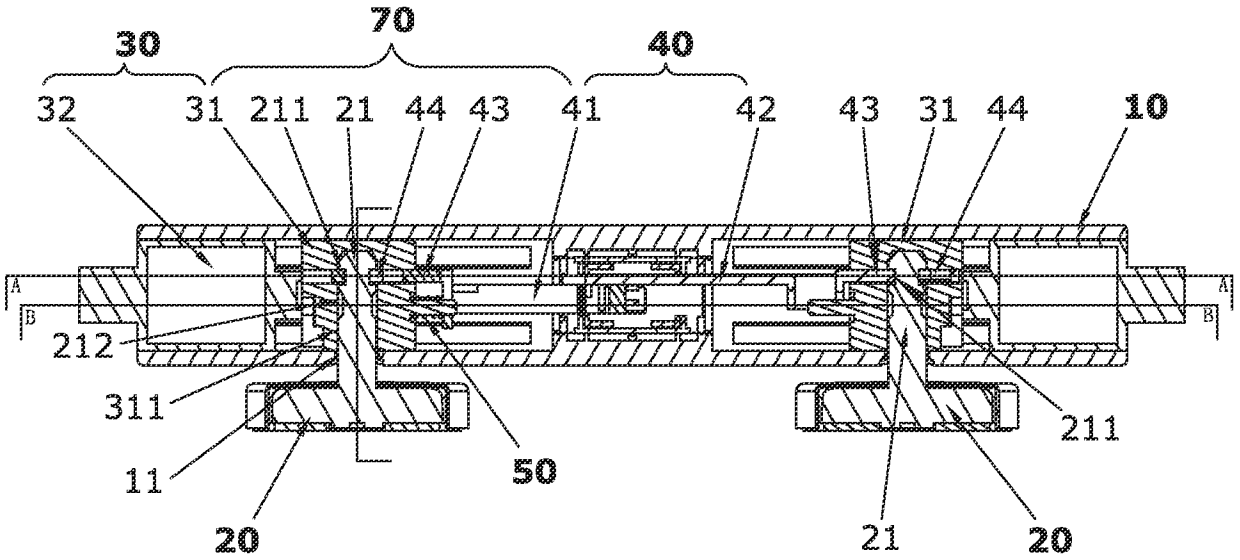
FIG. 3 illustrates the sectional view of the first embodiment of the present invention in lock state (in the axial direction of the straight tube).
Figure 4:
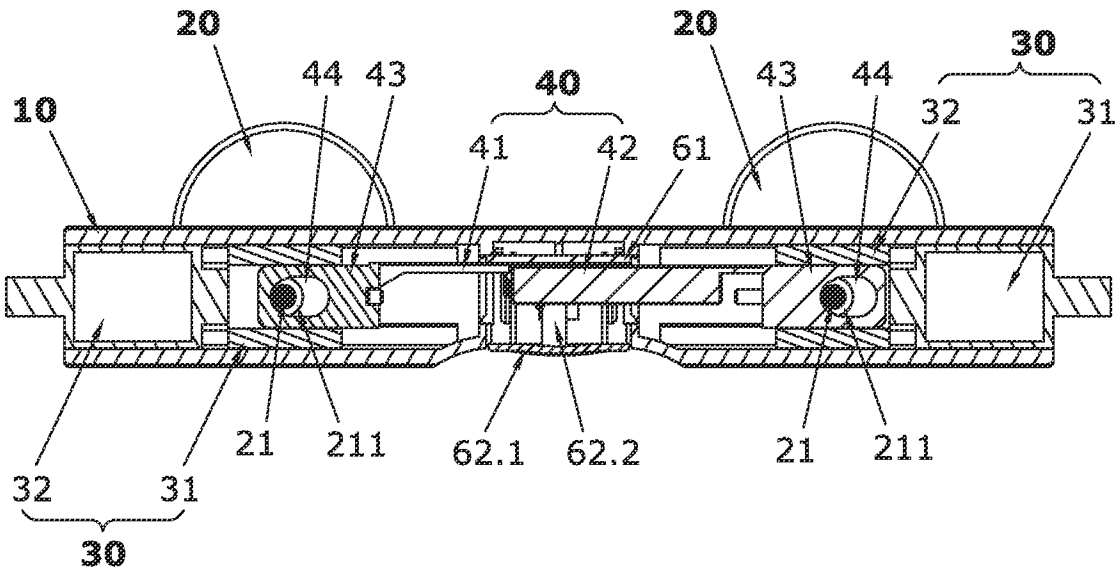
FIG. 4 illustrates the sectional view of the A-A of FIG. 3 (two ends of the lock bar are separately locked to the lock grooves of the pin).
Figure 5:
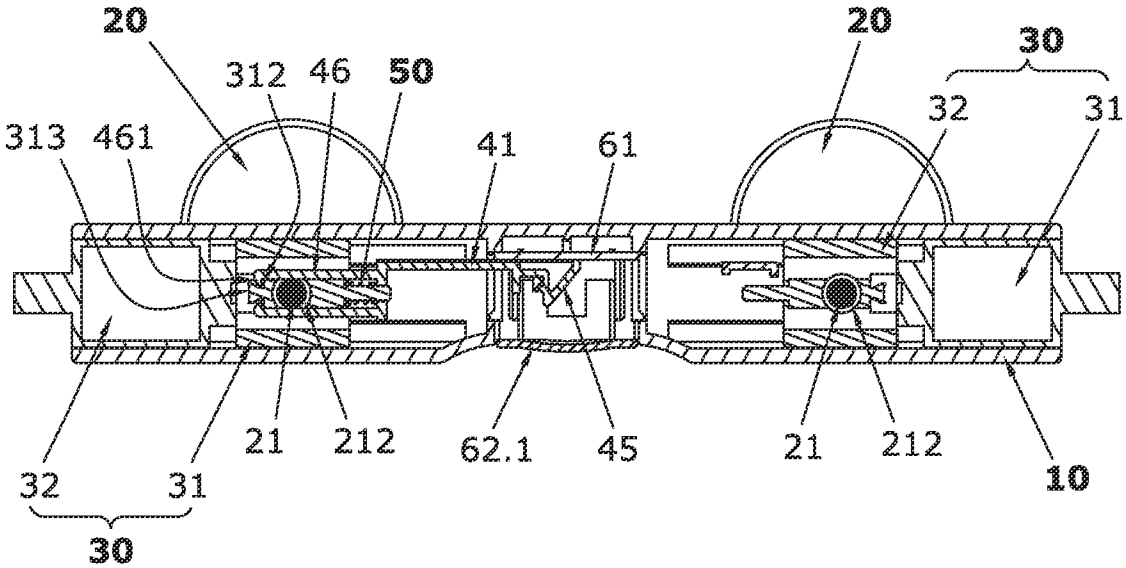
FIG. 5 illustrates the section view of the B-B of FIG. 3 (one end of the lock bar is locked to the lock surface of the pivot shaft).
Figure 6:
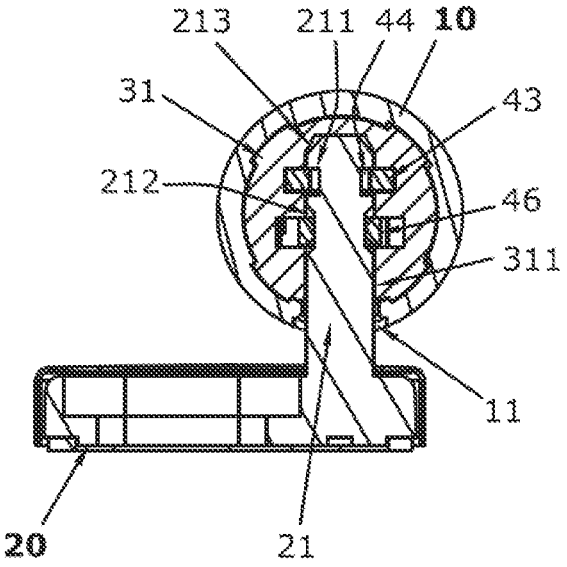
FIG. 6 illustrates the section view of the travel self-lock end of the lock bar of the FIG. 3 (in the radial direction of the straight tube).
Figure 7:
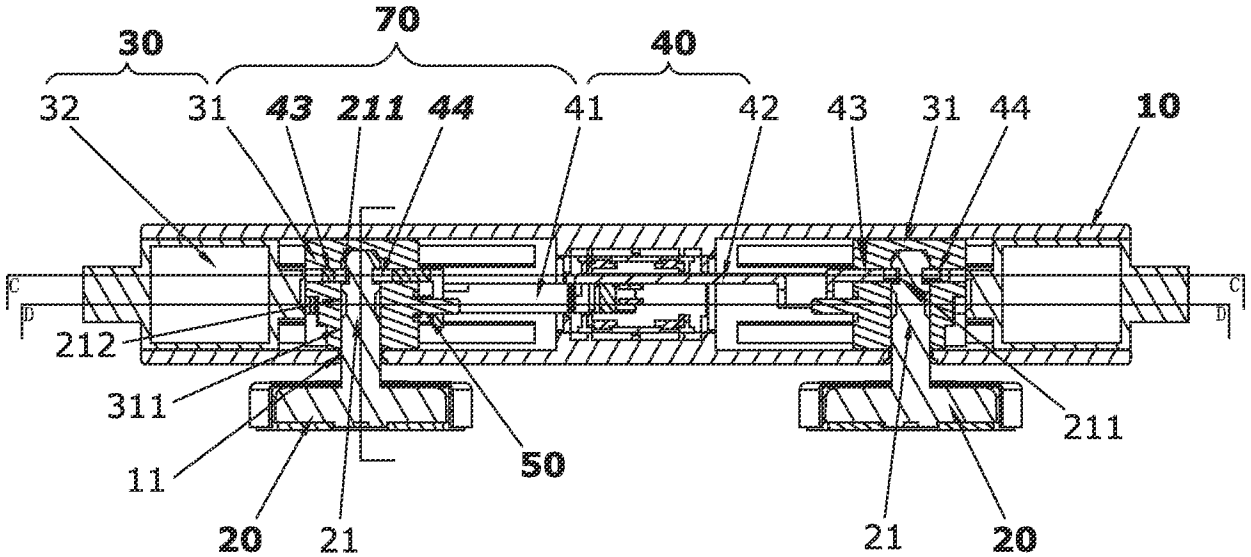
FIG. 7 illustrates the sectional view of the first embodiment of the present invention in unlock state (in the axial direction of the straight tube).
Figure 8:
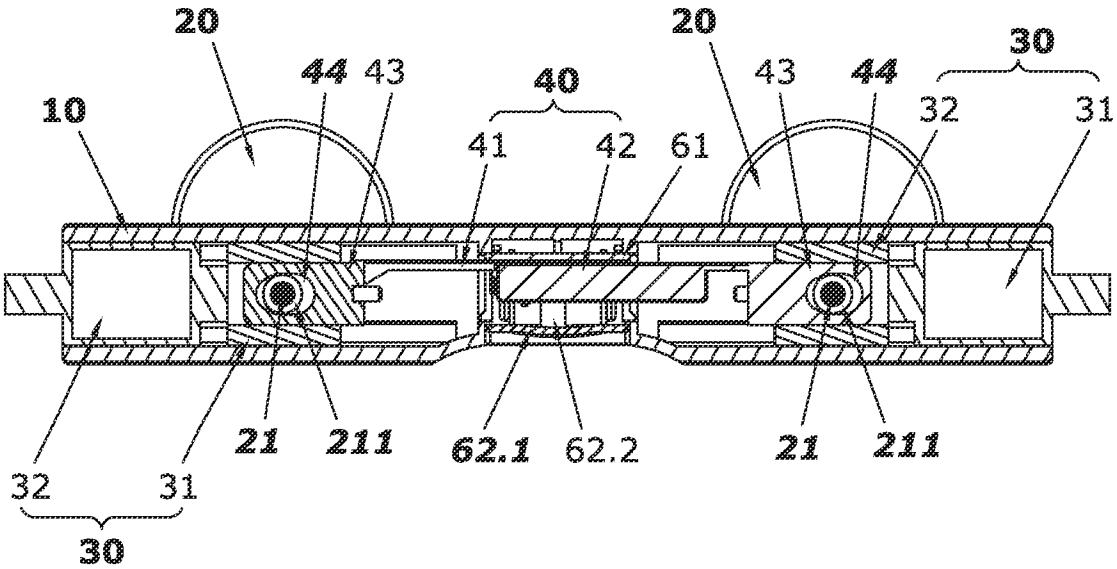
FIG. 8 illustrates the sectional view of the C-C of FIG. 7 (the button is pressed and two ends of the lock bar are separated from the pins)
Figure 9:
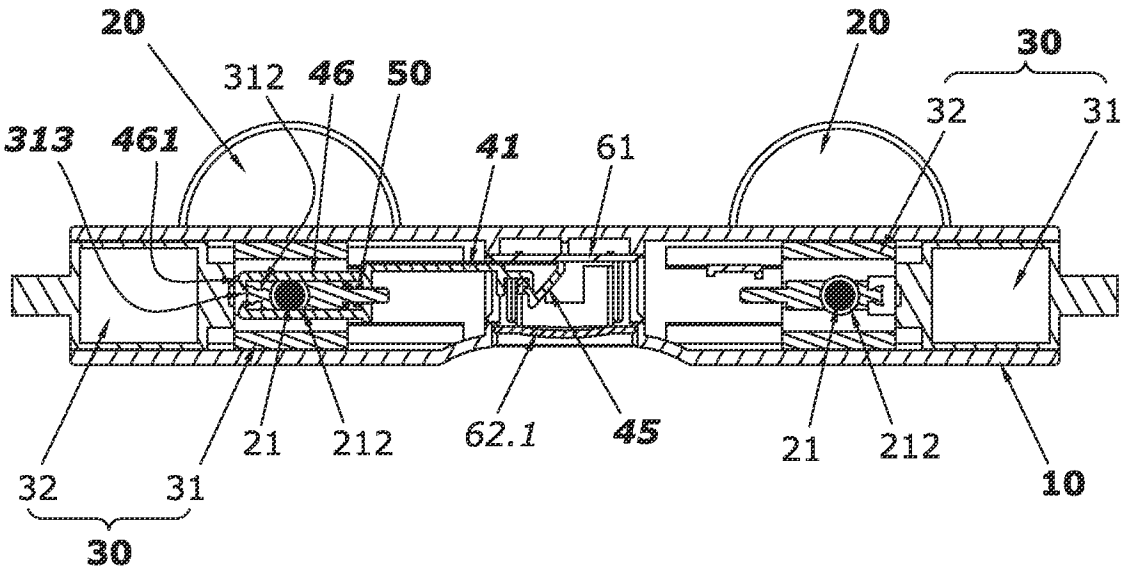
FIG. 9 illustrates the sectional view of the D-D of FIG. 7 (in one end of the lock bar, the elastic body is locked to the unlock surface of the pivot shaft).
Figure 10:
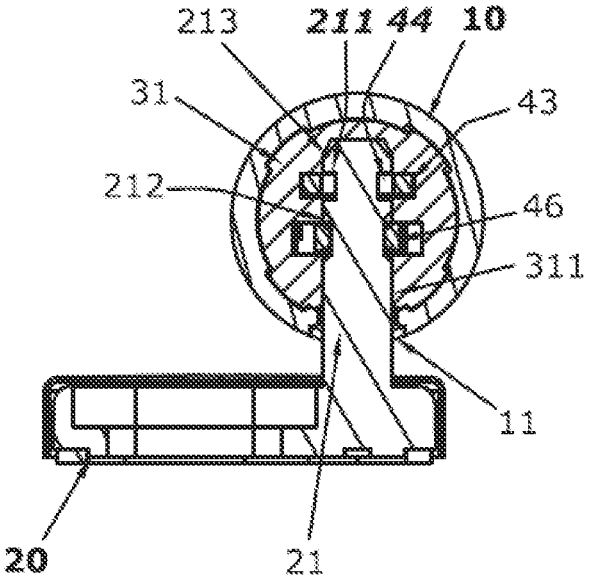
FIG. 10 illustrates the sectional view of the travel self-lock end of the lock bar of FIG. 7 (in the radial direction of the straight tube).
Figure 11:
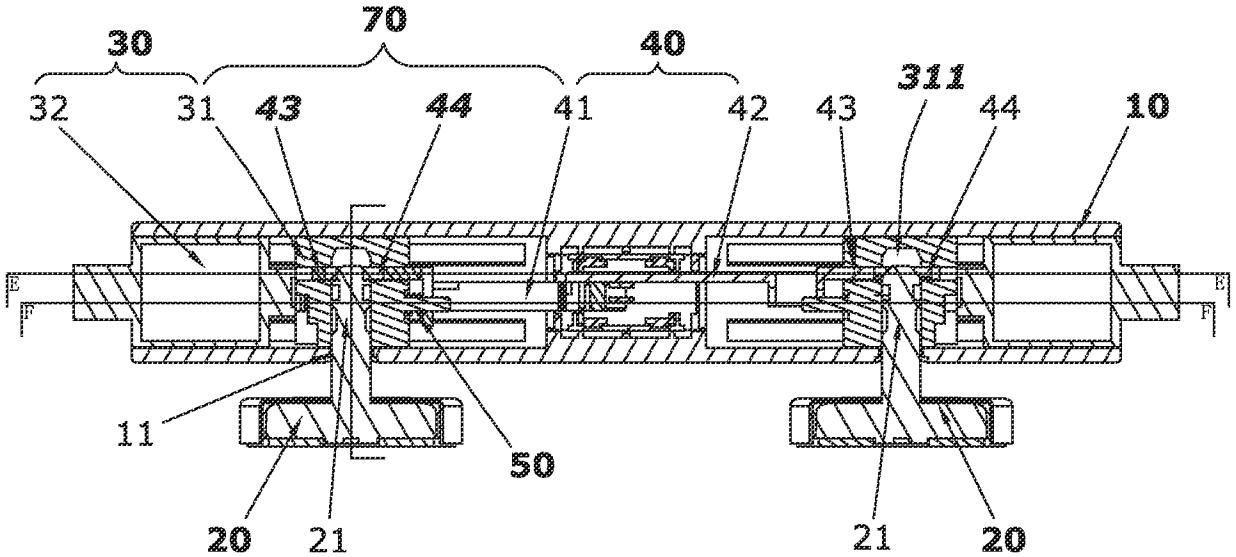
FIG. 11 illustrates the sectional view of the first embodiment of the present invention in unlock process (in the axial direction of the straight tube).
Figure 12:
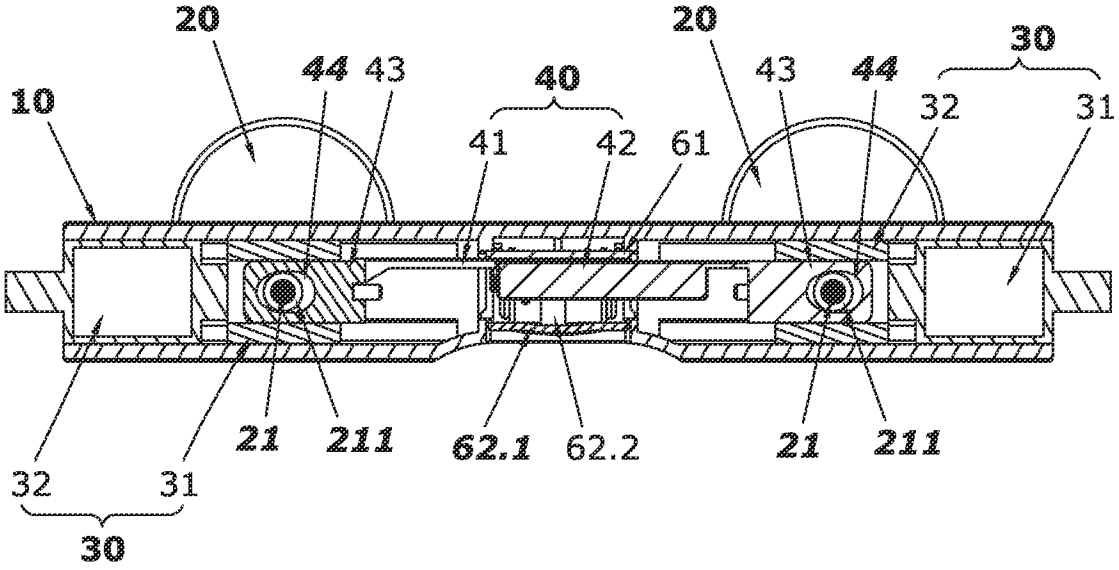
FIG. 12 illustrates the sectional view of the E-E of FIG. 11 (the pin is pull down from the lock hole).
Figure 13:
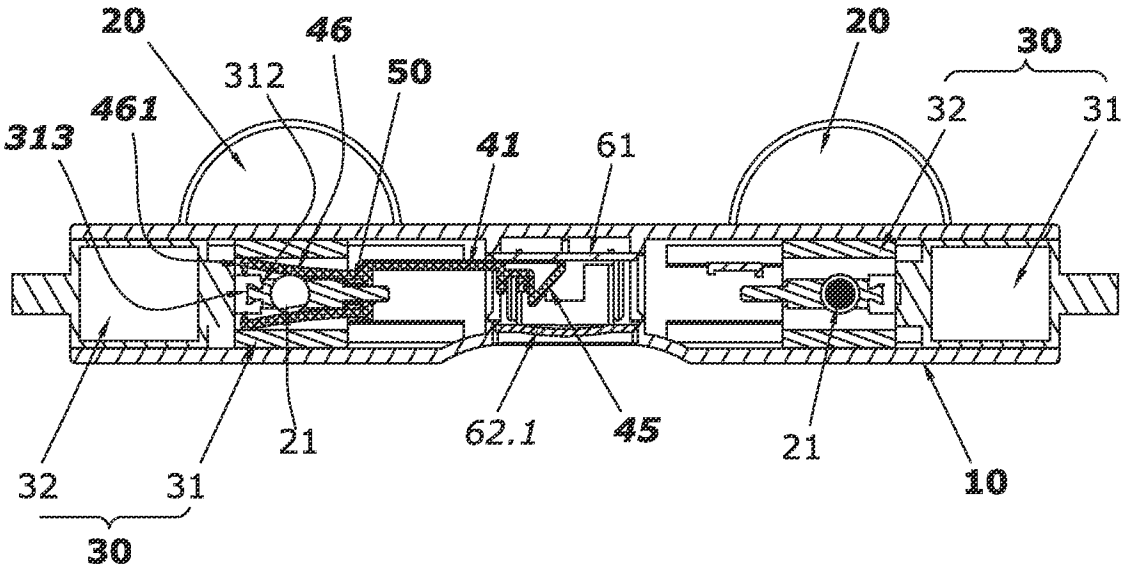
FIG. 13 illustrates the sectional view of the F-F of FIG. 11 (in one end of the lock bar, the elastic body is separated from the unlock surface of the pivot shaft).
Figure 14:
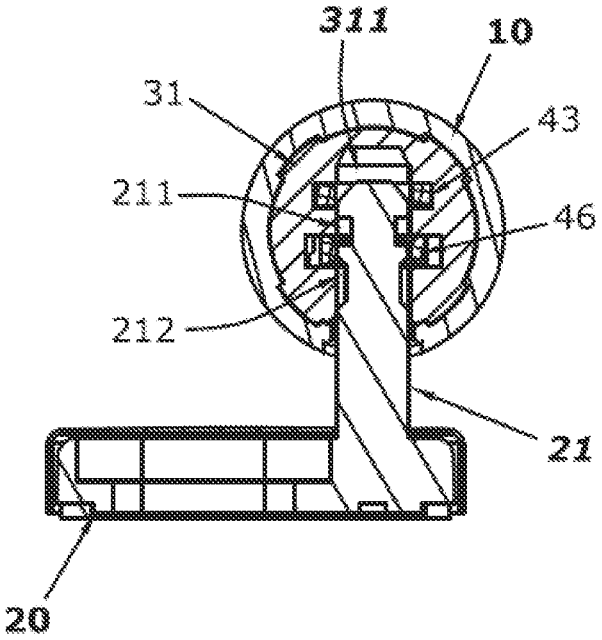
FIG. 14 illustrates the sectional view of the travel self-lock end of the lock bar of FIG. 11 (in the axial direction of the straight tube).

Straight tube 10; radial hole 11; sleeve hole 12; Stand 20; pin 21; lock groove 211; abdicating groove 212; pivot shaft 30; standstill shaft 31; pin hole 311; lock surface 312; unlock surface 313; rotary damper 32; lock bar 40; left lock bar 41; right lock bar 42; lock piece 43; lock hole 44; guiding block 45; elastic arm 46; inner hook 461; rack 47; pushing block 48; spring 50; operation mechanism 60; base 61; button 62.1; compression bar 62.2; gear 63; balance button 64; shifting lever 64.1. lock catch 70.

DETAILED DESCRIPTION OF THE EMBODIMENTS

The present invention will be further described with drawings and embodiments.

The First Embodiment

Push Type to Drive the Lock Bar to Move

As shown in FIG. 1 to FIG. 6. A quick assembly and disassembly mechanism with button lock for a toilet cover comprising an independent circular straight tube 10 pivot joint to middle of the rear part of the cover and two stands 20 to connect to the toilet, two pivot shafts 30 plugged to the shaft holes of the cover are symmetrically fixed to two ends of the straight tube 10, each pivot shaft 30 comprising a standstill shaft 31 and a rotary damper 32 coaxially, the standstill shaft 31 and the rotary damper 32 are sleeved into the straight tube 10, the rotary damper 32 is extended out of the end of the straight tube 10, the standstill shaft 31 is disposed with a pin hole 311 in the radial direction, the pin hole 311 is corresponding to the radial hole 11 of the straight tube 10 and it is plugged with the pin 21 of the stand 20; a lock bar 40 is disposed inside the straight tube 10 and between the two standstill shaft 31, the lock bar 40 can slide from side to side; the lock bar 40 comprising a left lock bar 41 and a right lock bar 42 locked to each other, the left end of the left lock bar 41 and the right end of the right lock bar 42 are separately disposed with a lock piece 43 to slide and lock to the standstill shaft 31 in the axial direction, each lock piece 43 is disposed with a lock hole 44, the right end of the left lock bar 41 is disposed with a guiding block 45 with guiding inclined surface, and a pair of elastic arms 46 with inner hook 461 in the inner side of the end in the opposite direction are disposed at the lower of the lock piece 43 of the end of the left lock bar 41, the standstill shaft 31 of the present invention is disposed with a lock surface 311 and an unlock surface 313 with interval in the axial direction, a spring is disposed between the standstill shaft 31 and the left lock bar 41 in the left side of the straight tube 10; in the present invention, the lock piece 43 of the left lock bar 41 and the elastic arm 46 are plugged into the standstill shaft 31 in the left in the axial direction, two inner hook 461 of the left lock bar 41 are hooked to the lock surface 312 of the standstill shaft 31 to form a lock catch 70; the lock piece 43 of the right lock bar 41 is plugged into the standstill shaft 31 in the right in the axial direction; the sleeve hole 12 in the middle of the straight tube 10 is disposed with an operation mechanism 60 to drive the lock bar 40 to slide, the base 61 of the operation mechanism 60 is sleeved and fixed to the sleeve hole 12 of the straight tube 10, the lock part of the left lock bar 41 and the right lock bar 42 is situated inside the base 61, the button 62.1 is assembled on the base 61 to be pressed, a compression bar 62.2 in the middle at the bottom of the button 62.1 is coupled to the guiding inclined surface of the guiding block 45 of the left lock bar 41. That is the assembly of the button lock mechanism.

Insert the pin 21 of the stand 20 into the radial pin hole 311 of the standstill shaft 31 through the hole 11 of the straight tube 10, during inserting the pin 21 to the pin hole 311, in the lock catch 70 in the left of the straight tube 10, the annular conical surface at the top of the pin 21 withstands the elastic arm 46 of the left lock bar 41 to extend a certain size, but the inner hook 461 will not separate from the lock surface 312, when the pins 21 in two ends of the straight tube 10 continue to insert into the lock hole 44 of the lock piece 43, the annular conical surface at the top of the pin 21 withstands the lock hole 44 to make the lock bar 40 sliding left a little distance, the travel of the inner hook 461 can't reach to the lock surface 313, the left lock bar 41 withstands the spring 50, when two pins 21 are plugged to the pin holes 311 completely, the lock bar 40 slides right and repositions quickly with the effect of the spring, that is to say, the lock hole 44 of the left lock bar 41 and the lock hole 44 of the right lock bar 42 are hooked and locked to the corresponding lock groove 211 in the pin 21 at the same time, two elastic arms 46 are clamped to the abdicating groove 212 at the lower of the lock groove 211 in the pin 21, that is the finish of the quick assembly of the standstill shafts 31 in two ends of the straight tube 10 and the stands 20, making it realized to quick assemble the cover and the toilet.

As shown in FIG. 1, FIG. 7 to FIG. 10. To disassemble the cover and the toilet quickly, press the button 62.1 on the operation mechanism 60, the compression bar 62.2 at the bottom of the button 62.1 will withstand the guiding inclined surface of the guiding block 45 of the left lock bar 41, making the entire lock bar 40 sliding to the left to the lock catch 70 inside the straight tube 10, in the lock catch 70, the elastic arm 46 moves in the abdicating groove 212 in the axial direction along the standstill shaft 31, making the inner hook 461 in the end of the elastic arm 46 of the left lock bar hooked to the unlock surface 313 of the standstill shaft 31 in the left, so the inner hook 461 is hooked to the unlock surface 313 to lock the sliding travel of the lock bar 40 to the left, that is to say, the travel of the lock bar 40 is self-locked by the lock catch 70, at this time, the edge of the lock hole 44 of the lock piece 43 of the left lock bar 41 and the right lock bar 42 is unlocked and separated from the lock groove 211 of the pin 21, and the lock hole 44 is left way to the pin 21, the lock of the two ends of the lock bar 40 to the pin 21 is released, then the pin 21 can be pull out of the pin hole 311 of the standstill shaft 31 and the hole 11 of the straight tube 10 to realize the quick disassembly of the cover and the toilet.

As shown in FIG. 11 to FIG. 14, during the quick disassembly of the cover and the toilet, when the pin 21 is pulled out of the standstill shaft 31, the abdicating groove 212 presses two elastic arms 46 of the left lock bar 41 downwards to extensional deform, the inner hook 461 in the end of the elastic arm 46 is separated from the unlock surface 313 of the standstill shaft 31 in the left, the elastic arms 46 are separated from the abdicating groove 212, with the effect of the spring 50, the left lock bar 41 and the right lock bar 42 slide right, and in the standstill shaft 31, the elastic arms 46 slide right and reposition, the inner hook 461 is hooked to the lock surface 312, the spring 50 repositions, during the repositioning of the lock bar 40, the guiding inclined surface of the guiding block 45 in the left lock bar 41 pushes the button 62.1 to reposition in a linkage way.

The Second Embodiment

Gear Type to Drive the Lock Bar to Move

Figure 15:
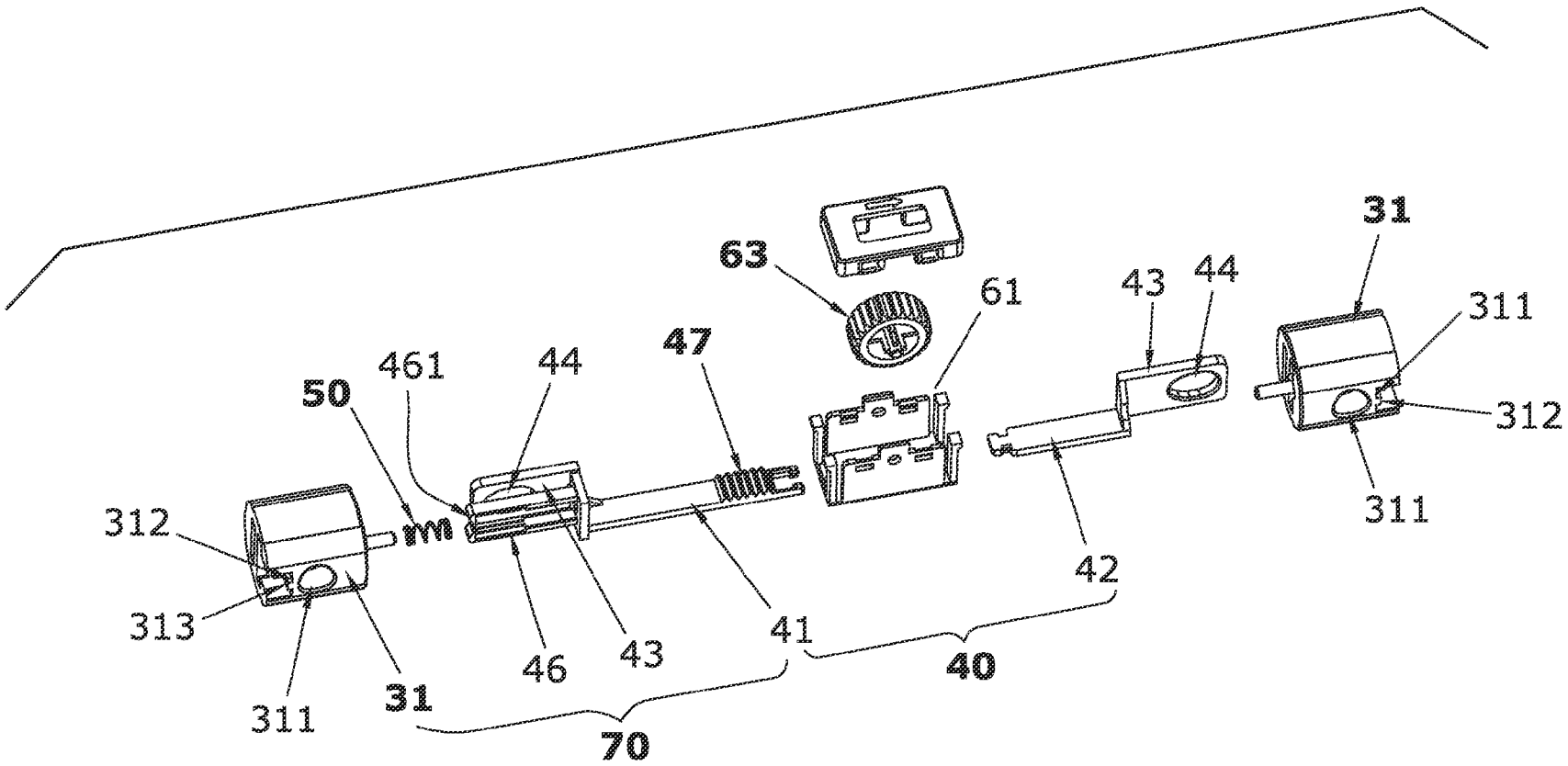
FIG. 15 illustrates the exploded view of the assembly of the lock bar and the operation mechanism of the second embodiment of the present invention.

As shown in FIG. 15, the difference from the first embodiment is as below: replace the button 62.1 in the operation mechanism 60 in the first embodiment by a gear 63 assemble in the base 61, replace the guiding block 45 of the left lock bar 41 of the lock bar 40 by a rack 47, the gear 63 is engaged to the rack 47, rotate the gear 63 to drive the rack 47 to move, making the lock bar 40 sliding left and the lock bar 40 locked to the unlock surface 313 of the standstill shaft 31 in the left by the inner hook 461 of the left lock bar 41, then the moving travel of the lock bar 40 in the lock catch 70 in the left end of the straight tube 10 is self-locked, when the lock catch 70 is unlocked, the lock bar 40 is repositioned with the effect of the spring force, the rack 47 drives the gear 63 to rotate in the opposite direction and reposition. The other structure, work principle and implementation means of the second embodiment is similar to the first embodiment.

The Third Embodiment

Lever Type Balance Button to Drive the Lock Bar to Move

Figure 16:
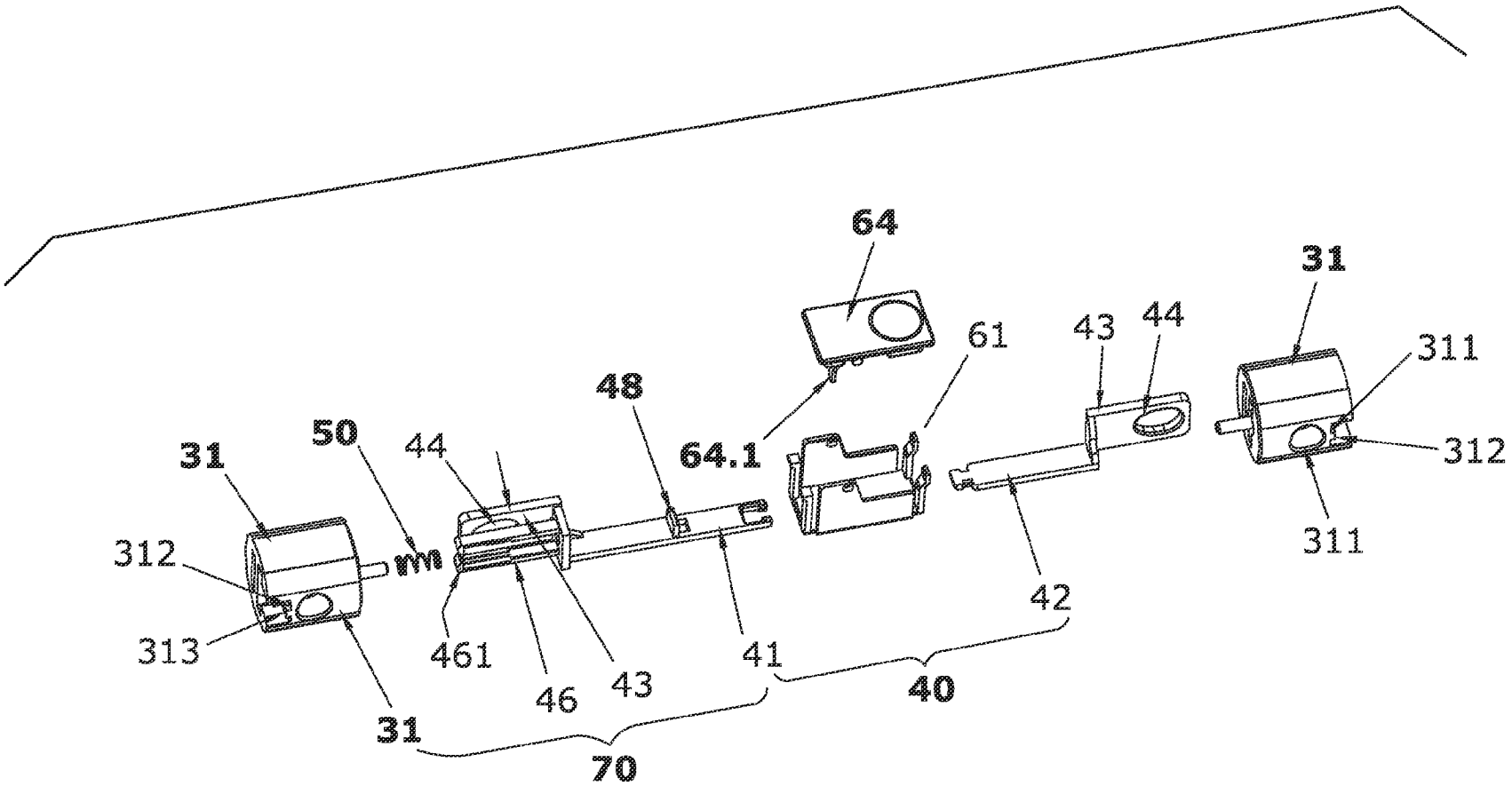
FIG. 16 illustrates the exploded view of the assembly of the lock bar and the operation mechanism of the third embodiment of the present invention.

As shown in FIG. 16, the difference from the first embodiment is as below: replace the button 62.1 of the operation mechanism in the first embodiment by a lever type balance button 64 assembled in the base 61, a shifting lever 64.1 is disposed at the bottom of the balance button 64, replace the guiding block 45 of the left lock bar 41 by a pushing block 48, press the balance button 64 to make the shifting lever 64.1 driving the pushing block 48 to drive the lock bar 40 to move; the other structure, work principle and implementation means of the second embodiment is similar to the first embodiment.

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

What is claimed is:

1. A quick assembly and disassembly mechanism with button lock for a toilet bar, comprising a straight tube pivot joint to the rear part of the cover, two stands connected to the toilet and two pivot shafts fixed to two ends of the straight tube symmetrically, the pivot shaft is disposed with in holes in the radial direction, the in holes are separately corresponding to the radial hole in the straight tube and the in holes are separately plugged with the pins of the stands, wherein:

a lock bar disposed between the two pivot shafts can slide from side to side, two ends of the lock bar can be plugged and cooperated to the two pivot shaft by axial sliding;

the straight tube is disposed with an operation mechanism to drive the lock bar to slide, the operation mechanism is linked and cooperated to the lock bar, a spring is disposed inside the straight tube to make the lock bar repositioned;

one end of the lock bar is disposed with a lock catch with lock hole, the other end is disposed with a lock piece with lock hole, the lock piece can be plugged and cooperated to the pivot shaft by axial sliding, the lock holes in two ends of the lock bar are moving in the same direction to lock to the pins, which are separately plugged to the in holes and the lock holes, or unlocked, wherein the operation mechanism comprising a base sleeved and fixed to the straight tube and a manual body assembled in the base, operate the manual body to cooperate with the driven body in the middle of the lock bar to drive the lock bar to move to one end of the lock catch.

2. A quick assembly and disassembly mechanism with button lock for a toilet bar according to claim 1, wherein the lock holes in two ends of the lock bar moves in the same direction to lock to a lock groove with reducing diameter in the pin, which is plugged to the pin hole and the lock hole, or unlock.

3. A quick assembly and disassembly mechanism with button lock for a toilet bar according to claim 1, wherein two ends of the spring are separately withstood one end of the pivot shaft and one end of the lock bar with lock catch.

4. A quick assembly and disassembly mechanism with button lock for a toilet cover according to claim 1, wherein the manual body is a button assembled in the base, the middle of the button is disposed with a compression bar, the driven body is a guiding block with a guiding inclined surface, the compression bar and the guiding inclined surface of the guiding block are cooperated to drive the lock bar to move.

5. A quick assembly and disassembly mechanism with button lock for a toilet cover according to claim 1, wherein the manual body is a gear assembled in the base, the driven body is a rack, the gear is engaged to the rack.

6. A quick assembly and disassembly mechanism with button lock for a toilet cover according to claim 1, wherein the manual body is a lever balance button assembled in the base, the bottom of the balance button is disposed with a shifting lever, the driven body is a pushing block, the shifting lever and the pushing block are cooperated to drive the lock bar to move.

7. A quick assembly and disassembly mechanism with button lock for a toilet cover according to claim 1, wherein the pivot shaft comprising a rotary damper and a standstill shaft, which are coaxially connected to each other, the pin hole is disposed in the standstill shaft, the standstill shaft is sleeved into the straight tube, the rotating damper is exposed out of the end of the straight tube, two ends of the lock bar are separately plugged to the two standstill shafts in the axial direction in sliding way.

8. A quick assembly and disassembly mechanism with button lock for a toilet cover according to claim 1, wherein the lock catch comprising an elastic body and a lock piece to limit the sliding travel of the lock bar and a pivot shaft, which is plugged to the end of the lock bar in sliding way;

in the lock catch, the lock piece in the end of the lock bar is disposed with a lock hole.

9. A quick assembly and disassembly mechanism with button lock for a toilet cover according to claim 8, wherein the pivot shaft comprising a rotary damper and a standstill shaft, which are coaxially connected to each other, the pin hole is disposed in the standstill shaft, the standstill shaft is sleeved into the straight tube, the rotating damper is exposed out of the end of the straight tube, two ends of the lock bar are separately plugged to the two standstill shafts in the axial direction in sliding way.

10. A quick assembly and disassembly mechanism with button lock for a toilet bar according to claim 1, wherein the lock bar comprising a left lock bar and a right lock bar fastened to each other, the driven body linked to the manual body is disposed in the left bar, which is cooperated to the lock catch in sliding way.

11. A quick assembly and disassembly mechanism with button lock for a toilet cover according to claim 10, wherein the manual body is a button assembled in the base, the middle of the button is disposed with a compression bar, the driven body is a guiding block with a guiding inclined surface, the compression bar and the guiding inclined surface of the guiding block are cooperated to drive the lock bar to move.

12. A quick assembly and disassembly mechanism with button lock for a toilet cover according to claim 10, wherein the manual body is a gear assembled in the base,
the driven body is a rack,
the gear is engaged to the rack.

13. A quick assembly and disassembly mechanism with button lock for a toilet cover according to claim 10, wherein
the manual body is a lever balance button assembled in the base,
the bottom of the balance button is disposed with a shifting lever,
the driven body is a pushing block,
the shifting lever and the pushing block are cooperated to drive the lock bar to move.

14. A quick assembly and disassembly mechanism with button lock for a toilet cover, comprising
a straight tube pivot joint to the rear part of the cover,
two stands connected to the toilet and two pivot shafts fixed to two ends of the straight tube symmetrically,
the pivot shaft is disposed with in holes in the radial direction,
the in holes are separately corresponding to the radial hole in the straight tube and
the in holes are separately plugged with the pins of the stands, wherein:
a lock bar disposed between the two pivot shafts can slide from side to side, two ends of the lock bar can be plugged and cooperated to the two pivot shaft by axial sliding;
the straight tube is disposed with an operation mechanism to drive the lock bar to slide,
the operation mechanism is linked and cooperated to the lock bar,
a spring is disposed inside the straight tube to make the lock bar repositioned;
one end of the lock bar is disposed with a lock catch with lock hole, the other end is disposed with a lock piece with lock hole,
the lock piece can be plugged and cooperated to the pivot shaft by axial sliding,
the lock holes in two ends of the lock bar are moving in the same direction to lock to the pins, which are separately plugged to the in holes and the lock holes, or unlocked,
wherein the pivot shaft is disposed with a lock surface and an unlock surface with interval in the axial direction;
in the lock catch,
when the elastic body is hooked to the lock surface, the lock holes are separately locked to the pins in two ends of the lock bar;
when the elastic body is hooked to the unlock surface, the lock holes are separately unlocked to the pins in two ends of the lock bar,
when the pin is separated from the pin hole, the pin withstands the elastic body to make the elastic body separated from the unlock surface.

15. A quick assembly and disassembly mechanism with button lock for a toilet cover according to claim 14, wherein
the elastic body in one end of the lock bar in the lock catch is a pair of elastic arms with inner hook, and
the ends of the elastic arms are disposed in the opposite direction,
the elastic arm is clamped to an abdicating groove disposed in the pin with reducing diameter,
the inner hook is hooked to the lock surface of the pivot shaft;
the lock bar slides to make the elastic arm deformed and hooked to the unlock surface of the pivot shaft;
when separated from the groove, the elastic arms are extensional deformed, making the inner hook separated from the unlock surface.

16. A quick assembly and disassembly mechanism with button lock for a toilet cover according to claim 15, wherein
the pivot shaft comprising a rotary damper and a standstill shaft, which are coaxially connected to each other,
the pin hole is disposed in the standstill shaft,
the standstill shaft is sleeved into the straight tube,
the rotating damper is exposed out of the end of the straight tube,
two ends of the lock bar are separately plugged to the two standstill shafts in the axial direction in sliding way.

17. A quick assembly and disassembly mechanism with button lock for a toilet cover, comprising
a straight tube pivot joint to the rear part of the cover,
two stands connected to the toilet and two pivot shafts fixed to two ends of the straight tube symmetrically,
the pivot shaft is disposed with in holes in the radial direction,
the in holes are separately corresponding to the radial hole in the straight tube and
the in holes are separately plugged with the pins of the stands, wherein:
a lock bar disposed between the two pivot shafts can slide from side to side, two ends of the lock bar can be plugged and cooperated to the two pivot shaft by axial sliding;
the straight tube is disposed with an operation mechanism to drive the lock bar to slide,
the operation mechanism is linked and cooperated to the lock bar,
a spring is disposed inside the straight tube to make the lock bar repositioned;
one end of the lock bar is disposed with a lock catch with lock hole, the other end is disposed with a lock piece with lock hole,
the lock piece can be plugged and cooperated to the pivot shaft by axial sliding,
the lock holes in two ends of the lock bar are moving in the same direction to lock to the pins, which are separately plugged to the in holes and the lock holes, or unlocked,
the lock catch comprising an elastic body and a lock piece to limit the sliding travel of the lock bar and a pivot shaft, which is plugged to the end of the lock bar in sliding way;
in the lock catch, the lock piece in the end of the lock bar is disposed with a lock hole,
wherein the pivot shaft is disposed with a lock surface and an unlock surface with interval in the axial direction;
in the lock catch,
when the elastic body is hooked to the lock surface, the lock holes are separately locked to the pins in two ends of the lock bar;
when the elastic body is hooked to the unlock surface, the lock holes are separately unlocked to the pins in two ends of the lock bar,
when the pin is separated from the pin hole, the pin withstands the elastic body to make the elastic body separated from the unlock surface.

18. A quick assembly and disassembly mechanism with button lock for a toilet cover according to claim 17, wherein
the elastic body in one end of the lock bar in the lock catch is a pair of elastic arms with inner hook, and
the ends of the elastic arms are disposed in the opposite direction, the elastic arm is clamped to an abdicating groove disposed in the pin with reducing diameter, the inner hook is hooked to the lock surface of the pivot shaft;

the lock bar slides to make the elastic arm deformed and hooked to the unlock surface of the pivot shaft;

when separated from the groove, the elastic arms are extensional deformed, making the inner hook separated from the unlock surface.

19. A quick assembly and disassembly mechanism with button lock for a toilet cover according to claim 18, wherein the pivot shaft comprising a rotary damper and a standstill shaft, which are coaxially connected to each other, the pin hole is disposed in the standstill shaft, the standstill shaft is sleeved into the straight tube, the rotating damper is exposed out of the end of the straight tube, two ends of the lock bar are separately plugged to the two standstill shafts in the axial direction in sliding way.

* * * * *